US006864851B2

(12) United States Patent
McGrath

(10) Patent No.: US 6,864,851 B2
(45) Date of Patent: Mar. 8, 2005

(54) LOW PROFILE WIDEBAND ANTENNA ARRAY

(75) Inventor: Daniel T. McGrath, McKinney, TX (US)

(73) Assignee: Raytheon Company, Waltham, MA (US)

( * ) Notice: Subject to any disclaimer, the term of this patent is extended or adjusted under 35 U.S.C. 154(b) by 138 days.

(21) Appl. No.: 10/255,313

(22) Filed: Sep. 26, 2002

(65) Prior Publication Data

US 2004/0061656 A1 Apr. 1, 2004

(51) Int. Cl.[7] ..... H01Q 13/00
(52) U.S. Cl. ..... 343/776; 343/705
(58) Field of Search ..... 343/776, 772, 343/705, 708; H01Q 13/00

(56) References Cited

U.S. PATENT DOCUMENTS 2,615,132 A * 10/1952 Rumsey ..... 343/772
2,817,084 A * 12/1957 Clapp et al. ..... 343/772
3,453,632 A * 7/1969 Harris ..... 343/772
3,818,490 A 6/1974 Leahy
4,862,186 A * 8/1989 Strider ..... 343/776
4,912,482 A * 3/1990 Woloszczuk ..... 343/841
5,579,020 A * 11/1996 Kinsey ..... 343/776

OTHER PUBLICATIONS

J.B. L Rao, S.R. Laxpati, B.D. Wright, "Widebrand phased array of coaxially–fed probes in parallel plate waveguides", Jun. 15–19, 1987, vol. 1, pp. 290–293.
Chu R S et al, "Analysis and experiment of a wideband phased array of monopole excited parallel plate waveguides", Jun. 26, 1989, pp. 974–977.

* cited by examiner

*Primary Examiner*—Hoanganh Le
(74) *Attorney, Agent, or Firm*—Renner, Otto, Boisselle & Sklar, LLP

(57) ABSTRACT

A phased array antenna having a low profile (approximately ⅛ wavelength) wide bandwidth (approximately 50%). The invention teaches making such an antenna using open channel resonators and monopole wave launchers. The wave launchers may conveniently be made on circuit card assemblies with strip lines that mimic coaxial cable monopole wave launchers. The channel resonators may be made in sections that are soldered to the circuit card assemblies. The circuit card assemblies have plated through holes that trace the edges of the resonator sections to provide electrical continuity.

20 Claims, 4 Drawing Sheets

LOW PROFILE WIDEBAND ANTENNA ARRAY

BACKGROUND OF THE INVENTION

A large number of antenna applications require low-profile antenna arrays that can be flush-mounted in or on a structure. Such antennas are usually referred to as "conformal array antennas." The designs available until now that are thin have been narrow band, permitting use only over a narrow range of frequencies. Conversely, those previously known antennas that are wide band have been thick, with excessive intrusion into, or protrusion from, the supporting structure.

Waveguide slots are one of the most common radiating elements used for low-profile array antennas. They are typically less than 0.25 wavelengths deep, but their bandwidth is only about 5 percent. Microstrip patch elements are another popular choice. They are even shallower than slot elements, but are also limited to about 5 percent bandwidth. In contrast, wide band radiating elements such as notches are usually about one wavelength deep.

SUMMARY OF THE INVENTION

The present invention teaches how to make a multichannel radar antenna that has a low profile and a wide bandwidth. The antenna is made with a series of channels that function as an array of open, parallel plate waveguides. Each channel includes at least one wave launcher. The channels are placed side-by-side to form a phased array. The wave launchers may be coaxial cables individually connected to the channels. Alternatively, the wave launchers may be fabricated from a pair of circuit cards with electrically conductive strip lines that form the electric equivalent of coaxial cables. The cards forming wave launchers and the cooperative metal channels can take a variety of forms. The channels may be open to the atmosphere, or they may be filled with a dielectric. The array may be flat or curved in one or two directions.

DESCRIPTION OF EMBODIMENTS OF THE INVENTION

Figure 1:
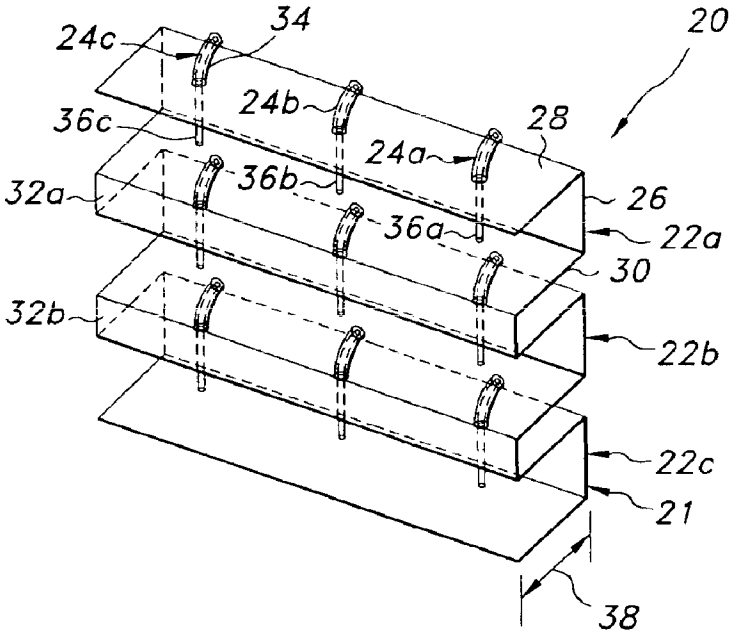
FIG. 1 is a perspective illustration of a simplified antenna constructed according to the present invention and using coaxial cables and parallel plate waveguides.

FIG. 1 shows a phased array radar antenna 20 utilizing the present invention. The antenna 20 in FIG. 1 has a metal structure 21 that forms three approximately horizontally extending channels 22*a*, 22*b*, 22*c*. In FIG. 1 the channels 22*a, b* and *c* are positioned one on top of the other and extend from left to right in the Figure. Each channel 22 includes at least one wave launcher 24, and illustrated each channel 22 has three wave launchers 24*a*, 24*b*, 24*c*. The channels 22 and wave launchers 24 therefore form a 3×3 array of parallel plate resonators.

Phased array antennas in general are constructed of identical wave launchers and cavities that are arranged in a predetermined (usually regular) array. In this application elements that are identical except for their location are given the same reference numerals with a letter suffixed. Similarly, to avoid unnecessary detail in many places this application describes in detail only one element or combination of elements. The other elements that differ only in position are identical to those described, as would be readily understood by those skilled in the art.

Each channel 22 has a back wall 26 and a top wall 28 and bottom wall 30 that form the channel. The walls 26, 28 and 30 are made of conductive material. The top and bottom walls 28, 30 lie in parallel planes, and the back wall 26 is perpendicular to them. The channels 22 are joined by conductive face plates 32 that position the channels parallel to each other. Thus, the cavity formed by each channel 22 has an open front and open lateral ends. The channels 22 and face plates 32 may conveniently be made of metal by conventional machining and manufacturing processes.

Each channel 22 includes at least one monopole wave launcher 24. In the embodiment of FIG. 1, the wave launchers 24 are coaxial cables, three in each channel. The outer shielding 34 of each coaxial cable is secured and electrically connected to the channel 22, and the inner cable conductor 36 extends into the cavity defined by the top, back, and bottom walls 26, 28, 30. The inner cables 36 are positioned perpendicular to the top and bottom walls 28 and 30 and parallel to the back wall 26.

The proportions of the walls 26, 28, 30 and the location and size of the wave launchers 24 are established by procedures known and understood by those skilled in the art to tune the antenna to a desired band of frequencies. Typically the distance 38 from the open front edge to the back wall is about ⅛ (one eighth) of the wave length of the signal for which the antenna is tuned. Together the top wall 28, back wall 26, bottom wall 30, and each monopole wave launcher 24 form a resonator.

An antenna made like that shown in FIG. 1 is expected to perform quite well. Not only is it relatively low profile, being only ⅛ wavelength deep, but it has a bandwidth of over 50%. However, the cost of manufacture would be quite high because of the need to attach the outer coaxial cables 34 to the channels 22 carefully in a very small space.

The antennas described below demonstrate various other ways to build an antenna that uses the teachings of the present invention, and that may prove easier to execute than that shown in FIG. 1. These antennas, like that shown in FIG. 1, are shown in small arrays, but it is readily apparent that the antennas described herein may be made to any desired size. In the following description the reference numerals used in connection with FIG. 1 are repeated for corresponding elements in the remaining antennas, where those elements have the same function and substantially identical structure. Where the structures vary significantly, they are assigned new reference numerals.

Figure 3:
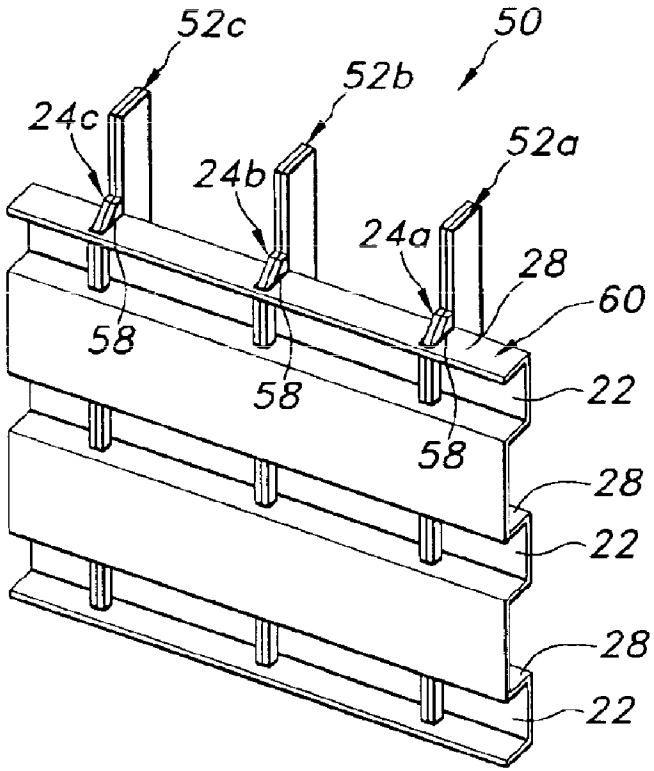
FIG. 3 is a perspective illustration of the antenna shown in partial exploded view in FIG. 2.
Figure 2:
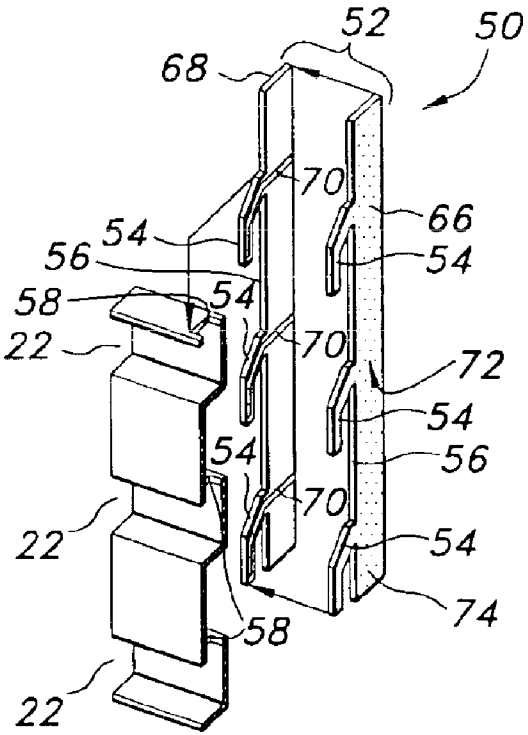
FIG. 2 is an exploded view of a part of a second antenna constructed using circuit cards in place of the coaxial cables of FIG. 1.

FIGS. 2 and 3 illustrate a second antenna 50 that uses the precepts of the present invention. Here the wave launchers 24 are formed on circuit card assemblies 52*a*, 52*b*, 52*c*.

Each circuit card assembly 52 (FIG. 2) is formed of two cards 66, 68 with appropriate electrically conductive strip lines 70 and 72 that form the electric equivalent of the coaxial cables 24 shown in FIG. 1. Specifically, the card 68 has a strip line 70 on the surface facing card 66, and the outside surfaces of the cards 66 and 68 have conductive material 72 on that part of the respective card that surrounds the strip line 70. Only the conductive material 72 on the outside surface of card 66 is shown. However, a mirror image of the material is also present on the outside surface of the card 68. Note that the conductive material 72 extends only part way down the tabs 54, stopping just where the tab extends through the opening 58. In this way the central strip line 70 can act as the center conductor of a coaxial cable. The two cards 66 and 68, shown separated in FIG. 2, are laminated to each other as shown in FIG. 3 to form a circuit card assembly 52. Each circuit card assembly 52 has a series of tabs 54, each tab extending out from the front edge 56 of the card and then downward. The tabs 54 fit through openings 58 in the metal structure 60 so that they can extend into the channels 22 at the desired locations.

The antenna 50 of FIG. 3 is assembled from three circuit card assemblies 52 and a metal structure 60 similar to that shown in FIG. 1. The metal structure has three channels 22*a, b* and *c* extending from left to right in the Figure. The top walls 28 of the channels are made with openings 58 or holes that fit the tabs 54 of the circuit card assemblies. Each circuit card assembly 52 is inserted into the openings 58 in the metal structure 60. Solder connections are made between the card assemblies 52 and the metal structure 60 as required. When assembled, the metal structure 60 and circuit card assemblies 52 form resonators, as shown in FIG. 3, a 3×3 array of resonators.

The circuit card assemblies 52 may be provided with appropriate connectors for electrical connection to the RF electronics that drive the antenna. Alternatively, the RF electronics may be directly attached to the circuit cards.

Figure 5:
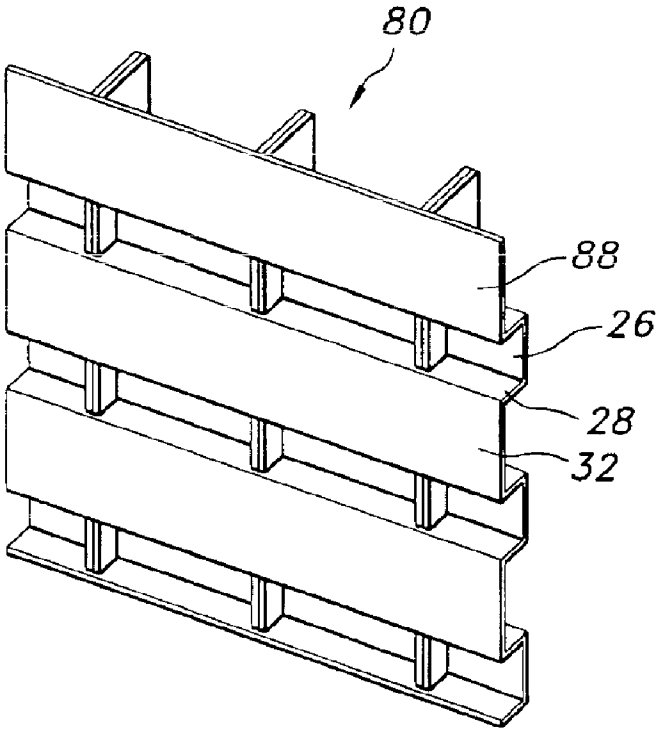
FIG. 5 used a perspective illustration of the antenna shown in a partially exploded view in FIG. 4.
Figure 4:
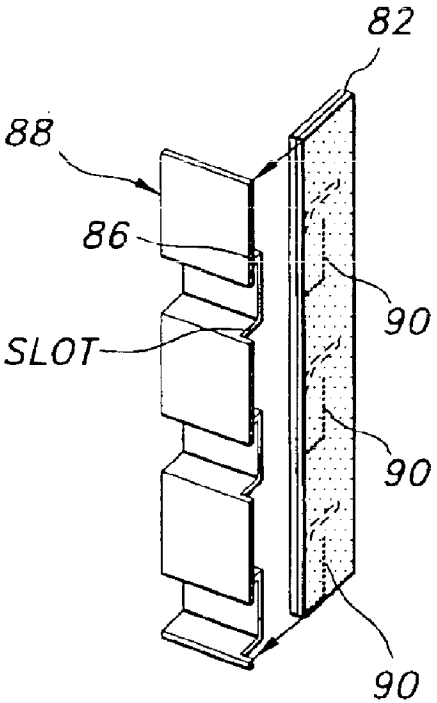
FIG. 4 is an exploded view of a part of parallel plate waveguide and a pair of circuit cards for making a third antenna constructed following the teachings of the present invention.

FIGS. 4 and 5 illustrate another antenna 80 made following the precepts of the present invention. Here the circuit card assemblies 82 are rectangular in overall shape. The strip lines 84 on the card assemblies have the same shape as in the antenna illustrated in FIGS. 2 and 3, but no tab is formed. Instead a slot 86 for each card assembly is cut down the back of the metal structure 88, with the slots being just wide enough to receive the card assemblies 82. The card assemblies 82 have plated through holes 90 that match the shape of the back wall 26 and bottom wall 30, and front faces 32 of the resonators. The plated through holes 90 are spaced so that they reflect radiation of the frequency band for which the antenna is to be used. Again the card assemblies 82 may or may not include RF electronics.

Figure 8:
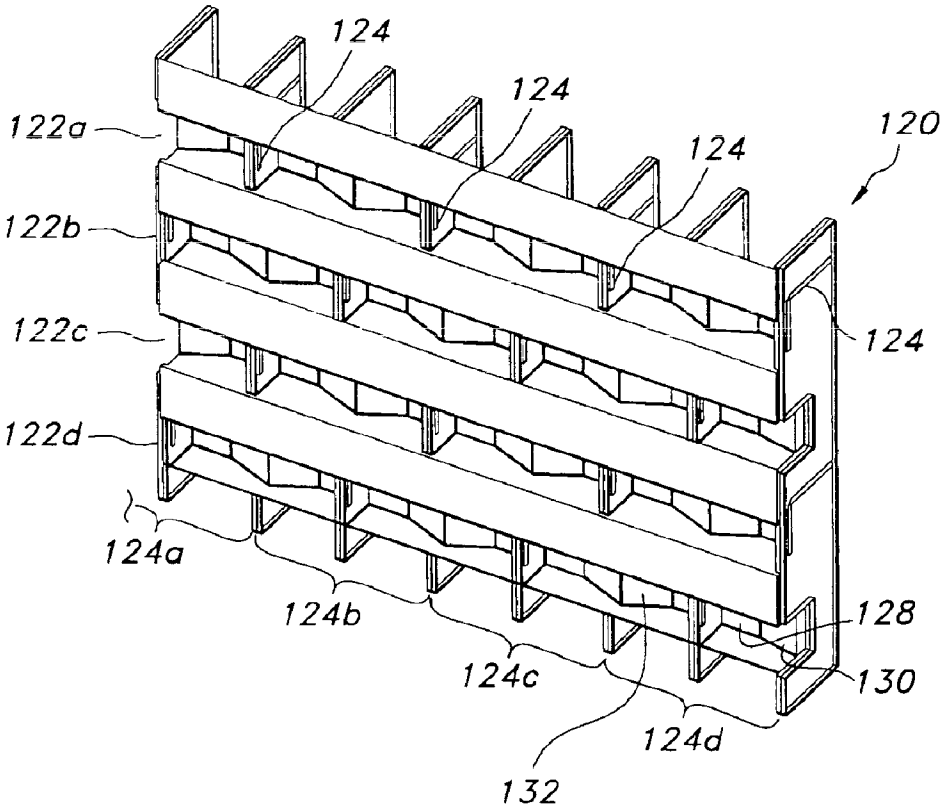
FIG. 8 is a perspective illustration of a fifth antenna constructed the following the teachings of the present invention.
Figure 7:
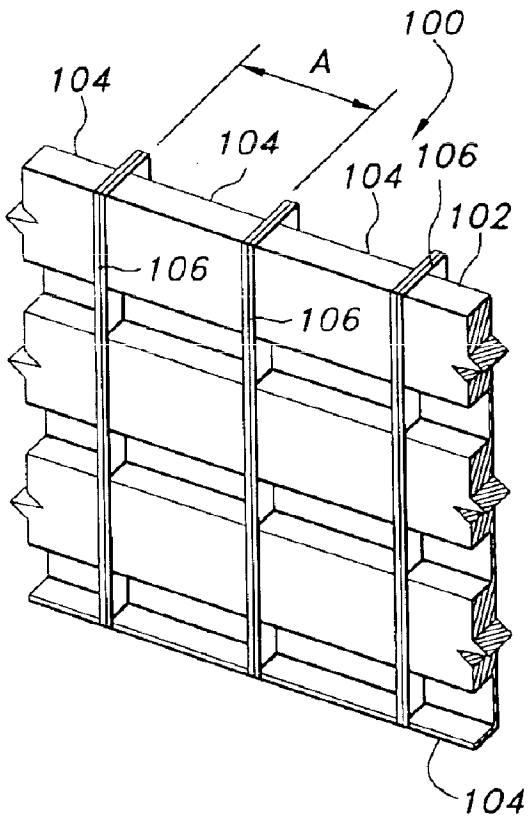
FIG. 7 is a perspective illustration of the antenna shown in a partially exploded view in FIG. 6.
Figure 6:
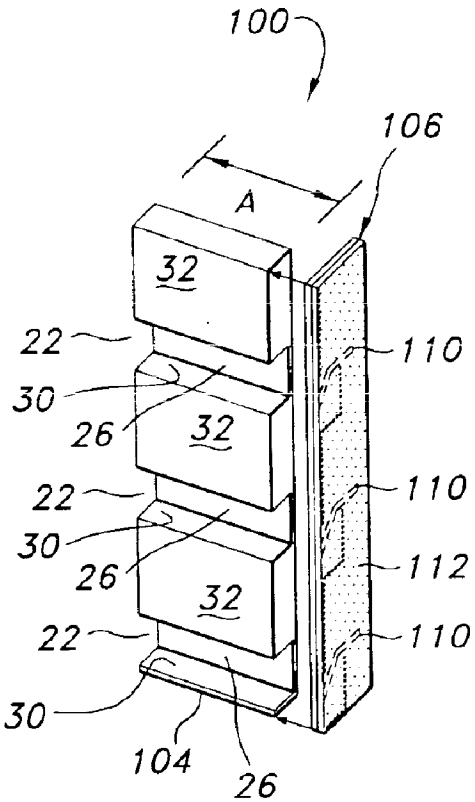
FIG. 6 is an exploded view of a part of a parallel plate waveguide and a pair of circuit cards for making a fourth antenna constructed according to the teachings of the present invention.

FIGS. 6 and 7 illustrate another antenna 100 constructed following the precepts of the present invention. Here the metal structure 102 has been divided into separate columns 104. The circuit card assemblies 106 have a series of plated through holes 108 that align with the faceplate 32, back wall 26, and bottom wall 30 of each resonator cavity 22. As before, the strip lines 110, 112 in the circuit card assemblies 106 form wave launchers. The antenna 100 is assembled by forming a sandwich with alternating circuit card assemblies 106 and metal columns 104. FIG. 8 illustrates an alternative antenna 120 constructed following the teachings of the present invention. The antenna 120 has four rows 122*a*, 122*b*, 122*c*, 122*d* of wave launchers 124 with four resonator cavities in each row 126*a*, 126*b*, 126*c*, 126*d* (only the resonators in row 122*d* are labeled). In addition, the back walls are not flat across their entire width as in the previously described antennas. Instead, the rear walls around each wave launcher 124 have a flat surface 128 and two oppositely inclined surfaces 130, 132 or "wedges". The wedges 130, 132 enhance antenna performance where only limited scanning in a single plane is required. Also unlike the antennas shown in FIGS. 1–7, the wave launchers 124 in the antenna 120 are staggered. Accordingly, the wave launchers 124 in rows 122*a* and 122*c* are aligned vertically with each other, as are the wave launchers in rows 122*b* and 122*d*, but the odd numbered rows are offset by one half the distance between the launchers from the launchers in the even numbered rows.

In any of the antennas 20, 50, 80 and 100, the depth of the channel 22 (or resonator cavity 124 in the case of antenna 120) may be reduced by filling the channel with a low loss dielectric material. Suitable materials include polystyrene, polyethylene and polytetrafluorethylene. Use of such a filler allows the antenna to be made shallower. This makes it better suited for applications such as aircraft or missiles where space is at a premium. The dielectric material may also cover the entire antenna array, allowing it to function as a radome. Further, to accommodate mounting on curved surfaces, an antenna constructed according to the teachings of the present invention need not be flat; the antenna may be curved in one or two planes.

What is claimed is:

1. A low-profile, phased array antenna comprising a plurality of parallel plate wave guides, each of the wave guides having an open front and open ends, and a plurality of wave launchers regularly arranged in a two-dimensional array, each wave launcher being positioned in one of the parallel plate waveguides; each wave launcher being formed by a strip line in a circuit board.

2. The antenna of claim 1 wherein each waveguide has parallel top and bottom walls adjacent a front opening and a rear wall extending between the top and bottom walls, the wave launcher having at least one linear element parallel to the rear wall.

3. The antenna of claim 2 wherein the distance between the opening and the rear wall is approximately ⅛ of the wavelength of the signal to be transmitted or received by the antenna.

4. The antenna of claim 1 including a circuit card on which at least one of the plurality of wave launchers is formed, the wave guides comprising reflective surfaces extending from opposite sides of the circuit card, the circuit card including a plurality of through-plated holes following the contours of the reflective surfaces and connecting them to each other.

5. The antenna of claim 4 wherein the circuit card includes a set of through-plated holes following the contours of a reflective surface associated with each of the wave launchers.

6. The antenna of claim 5 wherein the wave guides are formed from a plurality of waveguide subunits, the antenna including a plurality of said circuit cards, a waveguide subunit being mounted to each side of at least some of the cards.

7. The antenna of claim 6 wherein the reflective surfaces forming a back wall of at least one of the waveguides is formed of two planar panels intersecting each other along a line normal to the top and bottom walls.

8. The antenna of claim 7 wherein the back wall of at least one of the wave guides is formed of three planar panels, each perpendicular to the top and bottom walls.

9. The antenna of claim 7 wherein the back wall of at least one of the wave guides is formed of three planar panels, each of the panels extending transverse to the top and bottom walls.

10. The antenna of claim 4 wherein the reflective surfaces are integrally formed and include a slot for receiving the circuit card.

11. The antenna of claim 10 wherein the reflective surfaces include a plurality of parallel slots each for receiving an edge of a circuit card.

12. The antenna of claim 11 including a plurality of circuit cards, and wherein each of the circuit cards includes a plurality of through-plated holes aligned with the edges of the slot to connect the slot edges to each other.

13. The antenna of claim 11 wherein each of the circuit cards includes circuitry for processing signals to and from each of the wave launchers that are part of the circuit card.

14. The antenna of claim 1 wherein each of the wave guides is filled with a low-loss the dielectric material.

15. A low-profile phased array antenna comprising a plurality of parallel plate wave guides, each of the wave guides having an open front and open ends, and a plurality of wave launchers regularly arranged in a two-dimensional array, each wave launcher being positioned in one of the parallel plate waveguides;

wherein each waveguide has parallel top and bottom walls adjacent a front opening and a rear wall extending between the top and bottom walls, the wave launcher having at least one linear element parallel to the rear wall;

wherein the distance between the opening and the rear wall is approximately ⅛ of the wavelength of the signal to be transmitted or received by the antenna;

wherein one of the top and bottom walls of the wave guides includes an opening through which the respective launcher extends, the launcher comprising a strip on a printed circuit board.

16. The antenna of claim 15 wherein the circuit card includes an inner surface on which the strip is formed and two parallel outer surfaces on opposite sides of the inner surface, the outer surfaces including shielding on two sides of the strip.

17. The antenna of claim 15 wherein the printed circuit card includes a plurality of wave launchers extending from an edge of the circuit card and each configured to extend through the opening in a respective one of the top and bottom walls.

18. A phased array antenna comprising an array of periodically fed, open end, parallel plate wave guides;

wherein each waveguide includes a monopole wave launcher; and wherein each monopole wave launcher is formed by a strip line on a circuit board.

19. The antenna of claim 18 including a plurality of circuit cards, each having a plurality of wave launchers, each formed by a strip line in a circuit board.

20. The antenna of claim 18 wherein the wave guides are formed by metal subunits secured to opposite sides of the circuit cards, the circuit cards having through-plated holes maintaining electrical continuity between the metal subunits on each side of the circuit cards.

* * * * *

UNITED STATES PATENT AND TRADEMARK OFFICE

CERTIFICATE OF CORRECTION

PATENT NO. : 6,864,851 B2
APPLICATION NO. : 10/255313
DATED : March 8, 2005
INVENTOR(S) : Daniel T. McGrath It is certified that error appears in the above-identified patent and that said Letters Patent is hereby corrected as shown below:

Col. 1 lines 3-4, should read, add the following statement:

This invention was made with the United States Government support under Contract number WITHHELD. The United States Government has certain rights in this invention.

Signed and Sealed this

Thirteenth Day of May, 2008

JON W. DUDAS
*Director of the United States Patent and Trademark Office*